US008076832B2

(12) United States Patent
Okita

(10) Patent No.: US 8,076,832 B2
(45) Date of Patent: Dec. 13, 2011

(54) ELECTRON EMITTER STRUCTURE AND ASSOCIATED METHOD OF PRODUCING FIELD EMISSION DISPLAYS

(75) Inventor: Hiroyuki Okita, Tokyo (JP)

(73) Assignee: Sony Corporation, Tokyo (JP)

( * ) Notice: Subject to any disclaimer, the term of this patent is extended or adjusted under 35 U.S.C. 154(b) by 331 days.

(21) Appl. No.: 12/122,176

(22) Filed: May 16, 2008

(65) Prior Publication Data

US 2008/0290777 A1 Nov. 27, 2008

(30) Foreign Application Priority Data

May 25, 2007 (SG) ..... 200703695

(51) Int. Cl.
*H01J 1/02* (2006.01)

(52) U.S. Cl. ..... 313/309; 313/310; 313/336; 313/351

(58) Field of Classification Search ..... 313/309, 313/336, 351, 495
See application file for complete search history.

(56) References Cited

U.S. PATENT DOCUMENTS 3,921,022 A * 11/1975 Levine ..... 313/309
5,201,992 A 4/1993 Marcus et al.
5,229,331 A 7/1993 Doan et al.
5,290,610 A * 3/1994 Kane et al. ..... 427/577
5,663,611 A * 9/1997 Seats et al. ..... 313/584
5,766,829 A 6/1998 Cathey, Jr. et al.
5,773,920 A * 6/1998 Shaw et al. ..... 313/309
6,133,057 A 10/2000 Derraa
6,822,379 B2 * 11/2004 McClelland et al. ..... 313/309
6,825,596 B1 * 11/2004 Cathey ..... 313/336
7,345,415 B2 * 3/2008 Chen et al. ..... 313/495
2001/0040429 A1 11/2001 Zhang et al.
2002/0053869 A1 5/2002 Ahn et al.
2008/0290777 A1 * 11/2008 Okita ..... 313/309

FOREIGN PATENT DOCUMENTS

EP 0 789 382 A1 8/1997

* cited by examiner

*Primary Examiner* — Vip Patel

(74) *Attorney, Agent, or Firm* — Oblon, Spivak, McClelland, Maier & Neustadt, L.L.P.

(57) ABSTRACT

A method of forming an electron emitter structure for use in a field emission display, or as a field emission backlight for an LCD display is provided. The electron emitter structure is formed by depositing mask elements onto an laminar Al substrate, and etching the Al substrate chemically through gaps between the mask elements, such that a spikes are formed on the substrate. These spikes are then covered with an electron emitter material. The spikes can be formed with a desired pitch/height ratio.

7 Claims, 3 Drawing Sheets

ELECTRON EMITTER STRUCTURE AND ASSOCIATED METHOD OF PRODUCING FIELD EMISSION DISPLAYS

Methods for producing an electron emitter structure for a field emission display (FED), or a field emission backlight for a liquid crystal display (LCD), and also to the electron emitter structures, FEDs and field emission backlights so produced.

BACKGROUND

Field emission displays (FED) are among the most promising candidates for the next generation of displays. Field Emission Backlights for liquid crystal displays (LCD) also attract the interest of many researchers today.

One well-known type of electron emitter structure of a FED, a Spindt type emitter, is shown schematically in FIG. 1. A lower portion of the emitter comprises a glass substrate 1, covered by a lower electrode 2. A number of insulator elements 3 support gate electrode elements 4. This type of emitter has a small Mo cone 5, in electric contact with the lower electrode 2, as a cathode. When a large enough negative voltage is applied to the cone 5 (via the lower electrode 2) the electric field concentration at the top of the Mo cone 5 becomes high enough to expel electrons. The electrons are attracted across a gap to an upper portion of the FED, composed of an upper electrode (anode) 7, which is sandwiched by a phosphor layer 6 and a second glass substrate 8. The generation of light by the phosphor layer 6 can be controlled by controlling the voltages applied to the gate electrode elements 4, in particular so as to make certain areas brighter than others. If the gate elements 4 are omitted, the structure generates uniform light, and may also for example function as a uniform field emission backlight of an LCD.

This emitter array is fabricated using vacuum-processing machinery in a photo-lithographic process which needs many masks. The Mo cone 5 is deposited with the substrate tilted, and then by rotating it. The series of process steps is very complicated and expensive, and it is difficult to make exactly the same cone shape for each of the many emitters in the array, which leads to uneven electron emission properties.

Another type of emitter, a Carbon Nano Tube (CNT), also attracts much interest. FIG. 2 shows a schematic diagram of the CNT type FED. Elements having the same meaning as those in FIG. 1 are denoted by the same reference numerals. The only difference is that a plurality of CNTs 9 are used as each cathode.

The CNTs are grown perpendicular to the surface of the substrate 1 and the electric field concentration is high at the top of the CNTs. Carbon is well known for its high electron emission property, so CNT is a suitable material for an electron emitter. However, the CNT are normally grown in a vacuum and usually high temperature is required to make good quality CNTs, so the process is expensive, and the substrate also expensive because it has to withstand high temperature during the process.

To solve the CNT-related problems which are mentioned above, some researchers have proposed a binder having the consistency of a paste and containing independent CNTs. Such a binder is pasted onto the substrate in place of the CNT of FIG. 2, and some of the CNTs in the paste happen to project above the binder surface, and work as cathodes. Unfortunately, this method makes it difficult to achieve even electron emission in the array, and also there is also high contact resistance between the electrode 2 below the CNT paste and each CNT. Additionally, the independent CNTs themselves are an expensive material.

SUMMARY

A mask with a plurality of spaced-apart openings is formed on a surface of a substrate. The substrate is chemically etched through the openings, whereby portions of the substrate proximate each of the openings are removed, leaving the surface with a plurality of spikes. Each of the spikes may function as an electron emitter. If the substrate itself is not formed of an electron emission substance having suitable electron emission properties, a layer of such a material is deposited onto the structure. An exemplary electron emission substance is DLC.

By selecting the properties of the mask and the etching conditions, the geometrical properties of the spikes can be selected. Thus, certain embodiments of the invention provides spike structures which have an optimal pitch/height ratio. Isotropic chemical etching naturally tends to form a structure having a pitch/height ratio of substantially 2, which has been shown elsewhere to be ideal.

BRIEF DESCRIPTION OF THE DRAWINGS

A more complete appreciation of the inventions and many of the attendant advantages thereof will be readily obtained as the same becomes better understood by reference to the following detailed description when considered in connection with the accompanying drawings. However, the accompanying drawings and their exemplary depictions do not in any way limit the scope of the inventions embraced by this specification. The scope of the inventions embraced by the specification and drawings are defined by the words of the accompanying claims.

DETAILED DESCRIPTION

Referring firstly to FIG. 3(*a*), the starting point of a method which is an embodiment of the present invention is a laminar substrate 10 formed of Al. The thickness of the Al substrate is 0.4 mm (so that the substrate is an Al foil) and the purity of Al is 99.999%. As shown in FIG. 3(*b*), a layer 11 of anodized aluminum oxide (AAO) is formed on one major surface of the Al substrate 11 by an anodization step, followed by pore widening. The thickness of AAO layer is preferably less than 1 μm. The AAO layer 11 is formed with many through-holes 12 which are perpendicular to the surface of the substrate 10.

Figure 4:
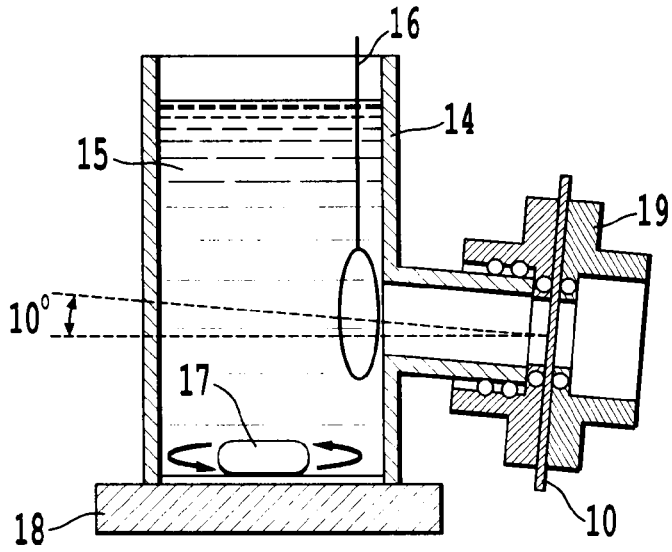
FIG. 4 shows schematically the anodization setup used in the embodiment of FIG. 3.

FIG. 4 shows schematically the setup used to perform the anodization. The Al foil 10 is supported by a support structure 19 with one of its two faces exposed to an acidic solution 15 within a bath 14. 0.4M H3PO4 is used as the acidic solution 15. The bath also contains a Pt wire 16, and an electric process is carried out in which the Al foil 10 functions as an anode and a Pt wire 16 as the cathode. A magnetic stirrer 17 is driven by a magnetic driver 18. A DC voltage is applied between the Pt wire 16 and the Al foil 10, for example 100V, and a layer of AAO is formed on the substrate 10. The AAO thickness is controlled by the anodization time, which may be 2 mins.

After the anodization, the pore widening process is conducted. In this process the surface of the Al substrate 10 having the AAO layer is soaked in 10 wt % H3PO4 solution for 70 mins. This process enlarges the pores, to the extent that the pores become through holes 12. The resulting thickness of the AAO elements 11 (in the vertical direction of FIG. 3(*b*)) is about 1 μm, the pore diameter is about 200 nm and the pore pitch (i.e. periodicity of the pores) is about 250 nm, such that the width of the elements 11 is about 50 nm.

As shown in FIG. 3(*c*), Ti layers 20 are then deposited in the respective pores by sputtering. Their thickness is about 300 nm.

As shown in FIG. 3(*d*), the AAO 11 is then removed completely using 10 wt % H3PO4 solution.

As shown in FIG. 3(*e*), the Al substrate 10 is etched using 10 wt % H3PO4 solution. In this process, the Ti layers 20 work as a mask and the etching proceeds isotropically as shown in this figure.

As shown in FIG. 3(*f*), the parts of the Al substrate 10 below the Ti masks 20 are made thinner by etching. Eventually, as shown in FIG. 3(*g*), the parts of the Al substrate 10 below the Ti masks 20 become too thin to support the Ti masks 20, and finally the Ti masks 20 are separated. The ratio of the pitch of the spikes and the height of the spikes (pitch/height) becomes about 2 because of the isotropic etching. This is significant because it has been reported in the paper Appl. Phys. A 83, 111-114 (2006), by Kim et al, entitled "Numerical study on the field emission properties of aligned carbon nano tubes using the hybrid field enhancement scheme", that when the pitch/height ratio of CNT is about 2, the maximum current density is obtained if the top of the spike is very sharp.

As shown in FIG. 3(*h*), a layer of DLC (diamond-like carbon) 21 is deposited on the Al substrate 10 by the filtered-cathodic-vacuum-arc (FCVA) method. DLC formed by FCVA is known for its high electron emission properties. In other embodiments, other low work function materials or low electron affinity materials may be deposited instead of DLC.

Figure 5:
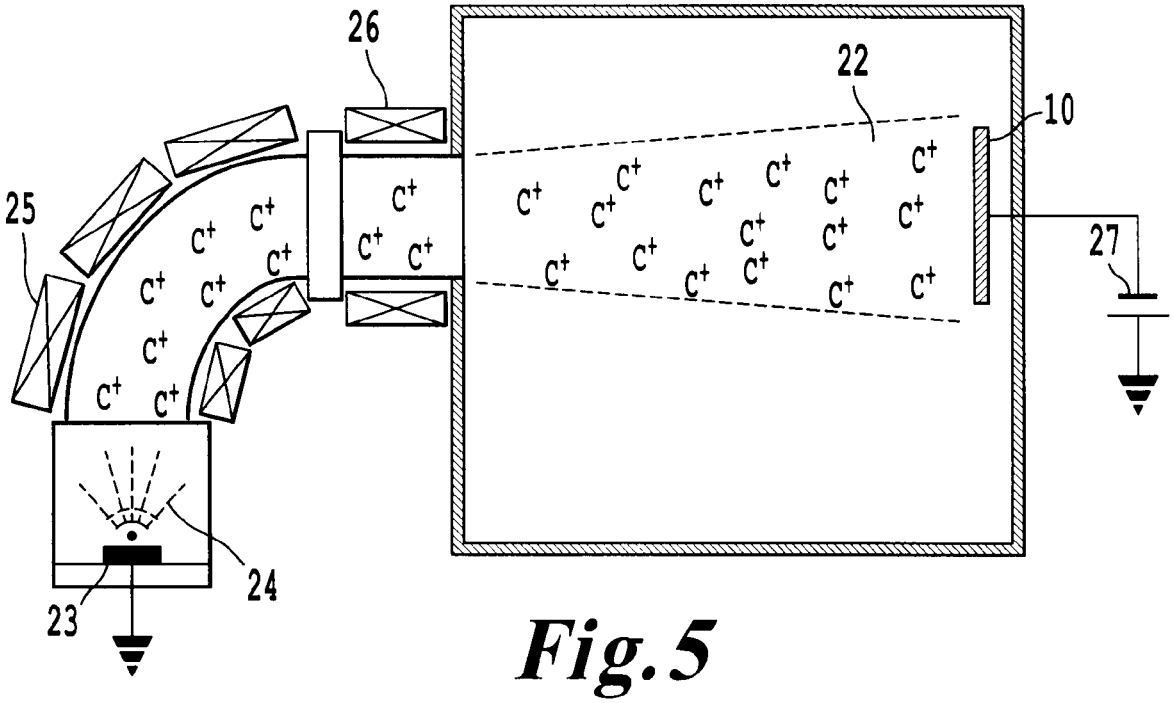
FIG. 5 shows schematically the filtered-cathodic-vacuum-arc (FCVA) deposition system used in the embodiment of FIG. 3.

The FCVA deposition system is shown in FIG. 5, where a carbon plasma 22 is produced through high current arcing 24 of a graphite cathode 23 in high vacuum conditions. A magnetic field produced by electromagnets 25 is created to steer the carbon plasma in a curved path towards the surface of the substrate 10, eliminating undesired macro-particles in order to produce a purer and denser film structure. Further electromagnets 26 perform a focusing function. The ion energy is controlled by the bias voltage, applied by a voltage generator 27, which is applied to a metal substrate holder (not shown) which holds the substrate 10. By optimizing the voltage bias during the deposition process, the film hardness, the film stress and the strength of adhesion can be controlled (as disclosed in U.S. Pat. No. 6,031,239, which is hereby incorporated by reference). Also the bonding structure of carbon ions can be controlled.

Figure 1:
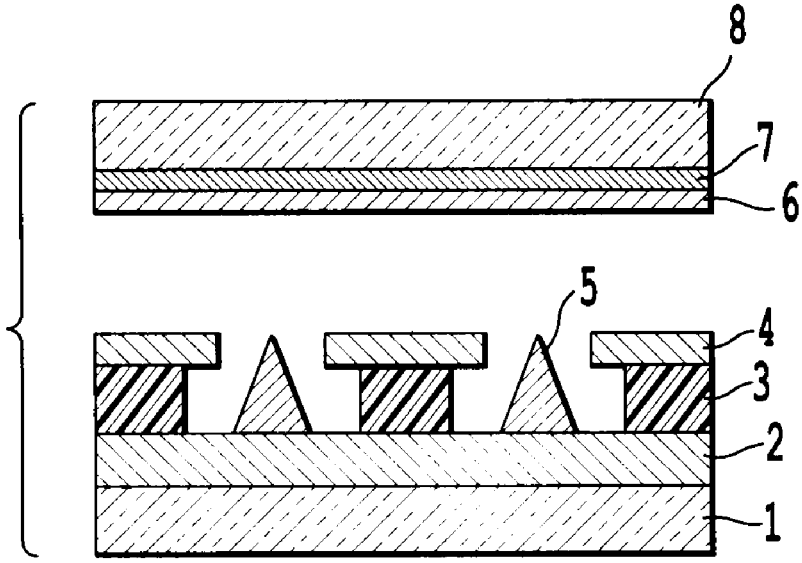
Fig. 1 PRIOR ART
FIG. 1 is a schematic diagram of the known Spindt type FED.
Figure 2:
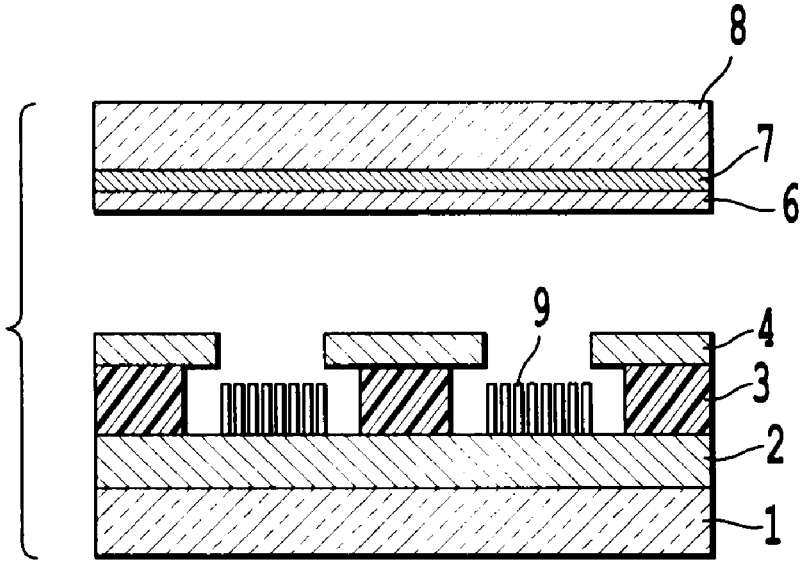
FIG. 2 is a schematic diagram of the known CNT type FED.
Figure 3A:
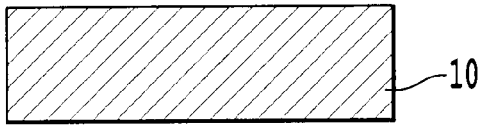
FIG. 3, which is composed of FIGS. 3(*a*) to 3(*h*), shows, using cross-sectional views, the steps of an exemplary process which is an embodiment of the present invention, to form spike structures on an Al substrate using AAO.
Figure 3B:
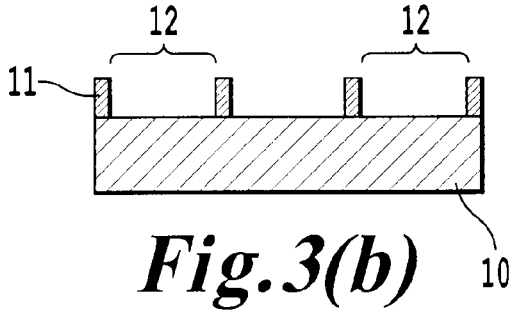
Figure 3C:
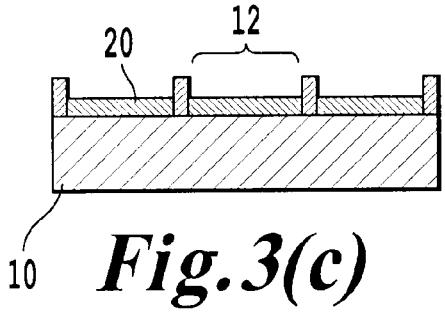
Figure 3D:
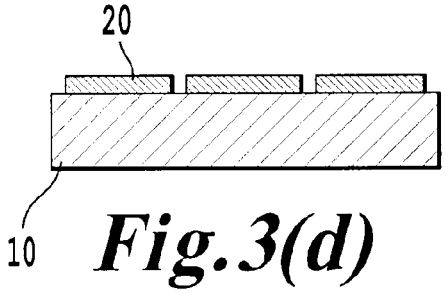
Figure 3E:
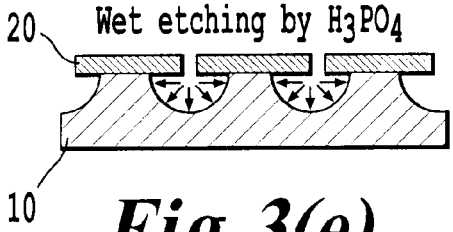
Figure 3F:
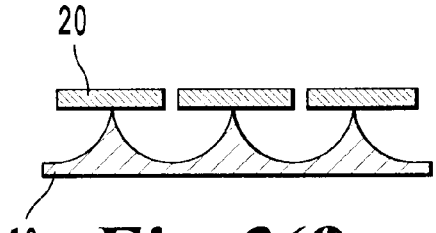
Figure 3G:
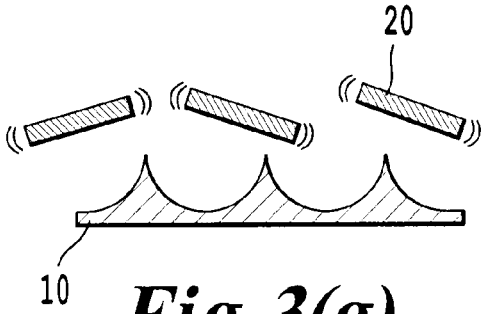
Figure 3H:
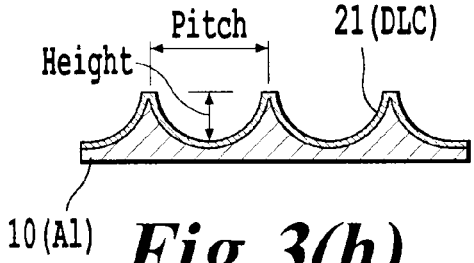

The structure produced in FIG. 3(*h*) can now be employed in a structure as shown in FIG. 1, replacing the cone 5 and the lower electrodes 2. If the gates 4 are omitted, the structure operates as a light-generator, such as a uniform field emission backlight for an LCD.

Note, however that nowadays many researches are trying to segment the backlight into many areas and to control the brightness of each area depending on a shown picture in order to increase the contrast of the shown picture and decrease the power consumption. Therefore even in systems in which the embodiment is employed as a backlight, the backlight may also be required to be controlled area by area.

It is to be understood that both the foregoing general description of the invention and the following detailed description are exemplary, but are not restrictive, of the invention.

The invention claimed is:

1. An electron emitter structure, comprising:

a substrate, one surface of the substrate being formed with a plurality of spikes; and an electron emitter material deposited over and in direct contact with the surface of the substrate, and the electron emitter material is entirely covering the one surface of the substrate.

2. An electron emitter structure according to claim 1, in which the plurality of spikes have a pitch/height ratio of substantially 2.

3. An electron emitter structure according to claim 1, in which the electron emitter material is diamond-like carbon (DLC).

4. A field emission display comprising the electron emitter structure of any of claims 1 to 3.

5. A field emission backlight for an LCD display comprising the electron emitter structure of any of claims 1 to 3.

6. An LCD display comprising a field emission backlight according to claim 5.

7. An electron emitter structure according to claim 1, wherein an uppermost portion of the electron emitter material located above the plurality of spikes has a flat surface.

* * * * *